US006353722B1

(12) United States Patent
Klimley et al.

(10) Patent No.: US 6,353,722 B1
(45) Date of Patent: Mar. 5, 2002

(54) WASTE BOTTLE WITH OVERFLOW CHAMBER

(75) Inventors: William R. Klimley; Donald M. Dinino, both of Rochester, NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/740,475

(22) Filed: Dec. 19, 2000

(51) Int. Cl.[7] ..... G03G 15/08
(52) U.S. Cl. ..... 399/257; 399/106
(58) Field of Search ..... 399/257, 252, 399/264, 103, 105, 106, 120, 360, 358; 222/DIG. 1

(56) References Cited

U.S. PATENT DOCUMENTS

| | | | | |
|---|---|---|---|---|
| 4,614,165 A | | 9/1986 | Folkins et al. | 399/257 |
| 4,625,895 A | | 12/1986 | Tsukano | 222/63 |
| 4,891,673 A | | 1/1990 | Buell | 399/257 |
| 5,250,749 A | | 10/1993 | Aimoto | 399/257 |
| 5,260,747 A | * | 11/1993 | Uwagawa et al. | 399/257 |
| 5,436,703 A | | 7/1995 | DeYoung et al. | 399/256 |

FOREIGN PATENT DOCUMENTS

| | | | |
|---|---|---|---|
| JP | 07-281571 | * | 10/1995 |
| JP | 10-232590 | * | 9/1998 |
| JP | 2000-98744 | * | 4/2000 |

* cited by examiner

*Primary Examiner*—Sophia S. Chen
(74) *Attorney, Agent, or Firm*—Bruce P. Watson

(57) ABSTRACT

A container for collecting waste developer in an electrostatographic printing machine employing a trickle type developing process and having a waste developer discharge tube with a discharge opening adjacent an outer end thereof for discharging waste developer. The container includes an outer wall enclosing an interior chamber, with a partition wall extending from an inner surface of the outer wall dividing the inner chamber into a collection chamber and an overflow chamber. An opening is formed in the outer wall into the overflow chamber. The opening is sized and shaped to receive the discharge tube therethrough. When received through the opening, the discharge tube extends through the overflow chamber, over an inner edge of the partition wall and into the collection chamber, with the discharge opening being located within the collection chamber. With this construction, the waste developer is discharged into the collection chamber.

11 Claims, 3 Drawing Sheets

WASTE BOTTLE WITH OVERFLOW CHAMBER

FIELD OF THE INVENTION

This invention relates generally to an electrophotographic printing machine, and more particularly concerns a waste developer bottle for collecting and disposing of waste developer.

BACKGROUND OF THE INVENTION

In the process of electrophotographic printing, a charge-retentive surface, also known as a photoreceptor, is charged to a substantially uniform potential, so as to sensitize the surface of the photoreceptor. The charged portion of the photoconductive surface is exposed to a light image of an original document being reproduced, or else a scanned laser image created by the action of digital image data acting on a laser source. The scanning or exposing step records an electrostatic latent image on the photoreceptor corresponding to the informational areas in the document to be printed or copied. After the latent image is recorded on the photoreceptor, the latent image is developed by causing toner particles to adhere electrostatically to the charged areas forming the latent image. This developed image on the photoreceptor is subsequently transferred to a sheet on which the desired image is to be printed. Finally, the toner on the sheet is heated to permanently fuse the toner image to the sheet.

One familiar type of development of an electrostatic image is called "two-component development." Two-component developer material largely comprises toner particles interspersed with carrier particles. The carrier particles are magnetically attractable, and the toner particles are caused to adhere triboelectrically to the carrier particles. This two-component developer can be conveyed, by means such as a "magnetic roll," to the electrostatic latent image, where toner particles become detached from the carrier particles and adhere to the electrostatic latent image.

Despite the practical advantages of two-component development, which has caused this type of development to become very common in printers and copiers available today, a common problem involving two-component development relates to the degradation of two-component developer material over the life of a printer or copier. One print quality problem results from the fact that, as the toner in developer material is gradually consumed by being placed on the photoreceptor, and then from the photoreceptor onto print sheets, a constant quantity of carrier particles remains in the system. Over time, the ratio of toner to carrier particles in the developer mixture drifts from an optimal level. Further, the frequency of print quality defects tends to increase with the increasing length of service of a two-component development system. Such print quality defects may be caused by dirt generation from developer material that is nearing the end of its useful life. At service calls, however, developer material is frequently changed without knowing the condition thereof, often resulting in wasteful discarding of developer material that is still of satisfactory quality.

U.S. Pat. No. 4,614,165, assigned to the assignee hereof and incorporated by reference herein, discloses the general principle of what is known familiarly as "trickle" development. Very briefly, trickle development involves providing two distinct supplies of developer: a main supply, from which the development unit draws developer for application to the electrostatic latent image, and a second, separate developer supply which is used to replenish the first supply over time. Typically, the two quantities of developer have substantially different ratios of toner to carrier. In the embodiment described in the '165 patent, for example, the first developer supply in the housing of the development unit is 96% carrier by weight and 4% toner by weight, while the developer material being gradually dispensed into the first supply is 25% carrier by weight and 75% toner by weight. Over the course of the lifetime of the printer, or at least of the development unit, the relatively toner-rich developer in the second supply is gradually discharged, or caused to "trickle," into the first developer supply. This trickling provides a substantially continuous replenishment of toner rich developer, and thereby maintains the effective ratio of toner to carrier within the main developer supply within an optimal range for a longer period of time. This trickling thereby extending the useful life and the optimal print quality associated with the development unit.

In a trickle development system, as a fresh supply of developer is discharged into the housing of the development unit, it is typically necessary that a similar quantity of surplus developer be discharged from the housing of the development unit. This surplus or "waste" material is commonly collected in a waste bottle. An auger contained in a transport tube is often used to transport the waste material through the tube to the waste bottle. The transport tube, with the auger therein, typically extends through a seal in an opening in the waste bottle. Waste material traveling through the transport tube is discharged into the waste bottle through an opening in the tube.

When the waste bottle becomes filled with waste developer, it is necessary to remove the full bottle and replace it with an empty bottle. The bottle is removed from the development unit by sliding the bottle off the end of the transport tube. If the waste bottle is filled to the top with developer, waste developer in the bottle is dragged by the auger vanes, which are exposed through the opening in the transport tube, and by the edges of the opening in the tube through the seal in the bottle. When the opening in the transport tube clears the seal, the developer that has been dragged through the seal falls from the auger and the transport tube into the machine. As a result, the interior of the machine becomes soiled with developer.

There is a need in the art for a toner waste bottle that can be removed from the waste auger without developer being dragged through the seal and soiling the machine.

SUMMARY OF THE INVENTION

One form of the invention provides a container for collecting waste developer discharged from a developer module through a waste developer discharge conduit, comprising: a housing defining a chamber including a partition wall dividing the chamber into a collection chamber and an overflow chamber, said housing having an opening formed in the region of the overflow chamber to receive said discharge conduit therethrough, said discharge conduit extending through said overflow chamber, over an inner edge of said partition wall and into said collection chamber, so that waste developer is discharged into said collection chamber.

Another form of the invention provides an electrostatographic reproduction machine comprising: a developer module having a discharge conduit extending therefrom for discharging waste developer from said developer module; a waste collection bottle enclosing a chamber including a partition wall separating said chamber into a collection chamber and an overflow chamber, said bottle having an inlet opening in the region of said overflow chamber, said discharge conduit extending through said inlet opening, through said overflow chamber, over an inner edge of said partition wall and into said collection chamber, such that said waste developer is discharged into said collection chamber.

BRIEF DESCRIPTION OF THE DRAWINGS

The invention will now be described, by way of example, with reference to the accompanying drawings, of which.

DETAILED DESCRIPTION OF AN EMBODIMENT OF THE INVENTION

While the present invention will be described by way of example with reference to one form of the present invention, it will be understood that it is not intended to limit the invention to the described embodiment. On the contrary, the present invention is intended to cover all alternatives, modifications, and equivalents as may be included within the spirit and scope of the invention as defined by the appended claims.

Figure 1:
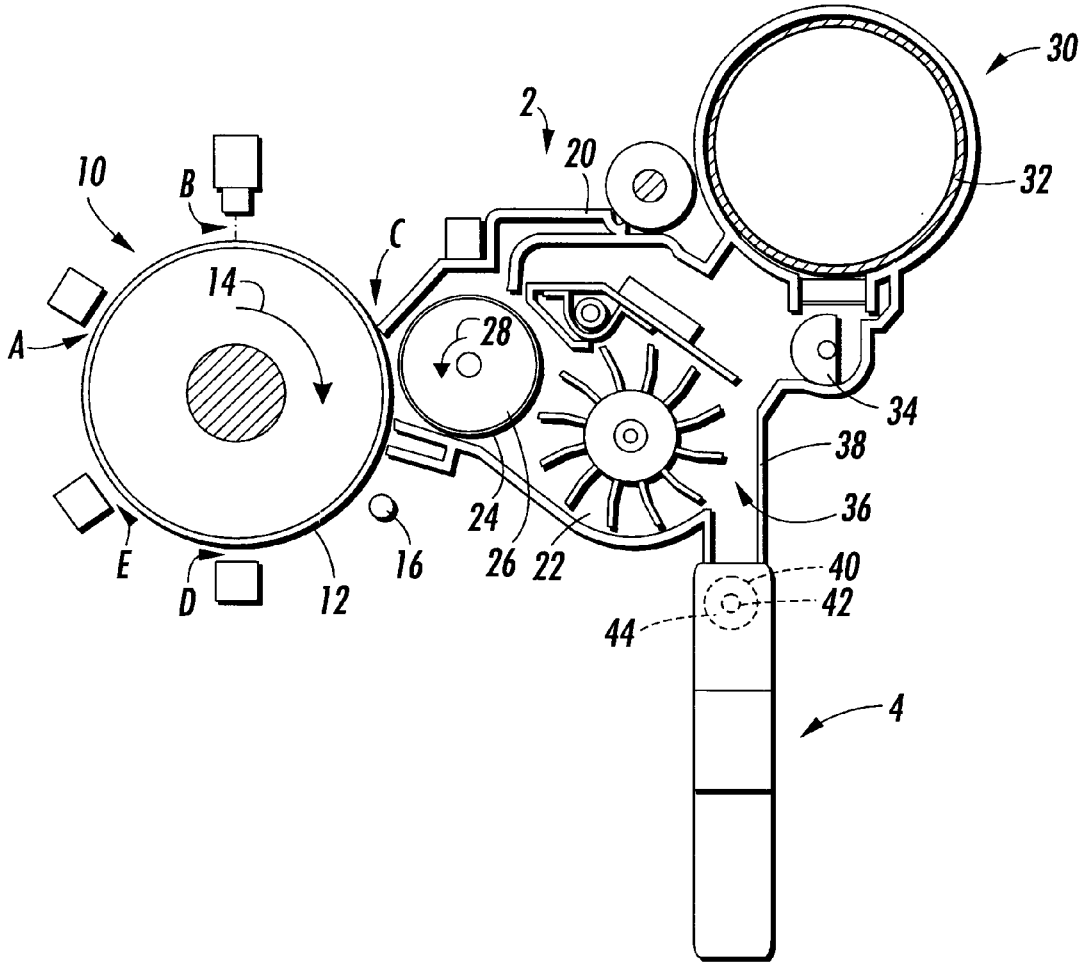
FIG. 1 is an illustrative cross-sectional view of a trickle type developer module having a developer waste bottle attached thereto.

FIG. 1 depicts the developer module 2 of an illustrative electrophotographic printing machine having a developer waste bottle 4 according to one form of the present invention. It will become evident from the following discussion that the disclosed waste bottle 4 is equally well suited for use in a wide variety of printing machines and is not necessarily limited in its application to the particular printing machine described herein.

As shown in FIG. 1, the illustrative electrophotographic printing machine employs a drum 10 having a photoconductive surface 12 adhering to a conductive substrate. The photoconductive surface may comprise a selenium alloy with the conductive substrate being an electrically grounded aluminum alloy. The drum 10 moves in the direction of arrow 14 to advance successive portions of the photoconductive surface 12 sequentially through the various processing stations A–E disposed about the periphery of the drum 10.

For purposes of the present disclosure, the several generally conventional electrophotographic processing stations in the path of movement of the photoconductive surface may be as follows. A charging station A, where the photoconductive surface 12 of the drum 10 is uniformly charged. An exposure station B, where a light or radiation pattern of a document to be printed is projected onto the photoconductive surface 12 to expose and discharge select areas of the photoconductive surface to form a latent image thereon. A developing station C, where xerographic developer is electrostatically applied to the photoconductive surface 12 of the drum to generate a toner image on the photoconductive surface. A transfer station D, where the toner image is electrostatically transferred from the photoconductive surface to a print sheet. Finally, a cleaning station E, where the photoconductive surface 12 is brushed or otherwise cleared of residual toner particles remaining thereon after image transfer.

Print sheets (not shown) supplied from a sheet feeding tray (not shown), are fed by appropriate conveying means (not shown) to the transfer station D. At the transfer station, the developed toner image is transferred from the photoconductive surface 12 of the drum 10 to the sheet. The sheet is then stripped from the photoreceptor belt by a sheet stripper 16 and transported to a fusing station (not shown), where the toner image is fused to the print sheet in a known manner. The print sheet, which now has an image fused to a first face thereof, is then transported to an output tray (not shown).

The developer module 2 is located at the developing station C. The developing unit includes a developer housing 20 defining a developer chamber 22 storing a supply of developer material including carrier granules and toner particles (not shown). A tubular sleeve 24 is rotatably mounted on a shaft within the developer chamber 22. An elongate cylindrical magnet 26 is mounted inside sleeve 24. The magnet is mounted stationarily within the sleeve and has a plurality of magnetic poles formed on its outer circumferential surface to generate a magnetic field. A motor (not shown) rotates the sleeve 24 in the direction of arrow 28. The developer material is attracted to the sleeve by the magnetic field generated by the magnet, and the rotation 28 of the sleeve transports the developer material attracted thereto closely adjacent to or into contact with the photoconductive surface 12 at the developing station C. The toner particles in the developer are attracted from the carrier granules to the latent image recorded on the photoconductive surface 12 of the drum 10, thereby developing a toner image on the drum. The sleeve 24 is electrically biased by a voltage source (not shown) in a known manner, in order to facilitate transfer of the toner from the carrier beads to the latent image on the drum.

As the latent image is being developed at the developing station C, the toner particles are being depleted form the developer material in the developer chamber 22 and require replenishment to maintain the carrier to toner ratio within an optimum range. In addition, the carrier granules and toner particles in the chamber age and must periodically be replaced in order to maintain the desired print quality. In order to provide the developer in the developer module with a useful life, preferably at least as long as the useful life of the photoconductive surface 12 on the drum 10, a replenishing stream of a toner rich mixture of carrier granules and toner particles, (replenisher) is trickled into the developer 22.

A discharging unit, indicated generally by the reference numeral 30, dispenses replenisher to developer chamber 22. Discharging unit 30 is shown as being adjacent to the developer chamber 22 in the developer housing 20. However, one skilled in the art will appreciate that the discharging unit may be located within the chamber 22 or remote therefrom as well. Discharging unit 30 includes hopper 32 having a segmented feed roller 34 positioned in a lower end thereof. Replenisher is stored in the hopper 32. As the feed roller 34 rotates, replenisher is discharged from the hopper into developer chamber 22. The ratio of toner particles to carrier granules by weight in the replenisher being discharged from hopper is substantially greater than the ratio of toner particles to carrier granules by weight in the developer material in the developer chamber 22. By way of example, the replenisher being dispensed from discharging unit may be 25% carrier granules by weight and 75% toner particles by weight, while the developer material in the developer chamber may be about 96% carrier granules by weight and 4% toner particles by weight.

As developer is trickled into the developer chamber 22, it is often necessary to remove excess developer material from the developer chamber 22, in order to maintain the proper level of developer in the developer chamber. This excess or waste developer material escapes through an opening 36 in the developer housing 20 outer wall, down a short duct 38 and into a transport or auger tube 40 containing an auger 42. A motor (not shown) rotates the auger, whereby the auger rotates in the tube, such that the vanes 44 of the auger transport the waste developer through the auger tube to the waste bottle 4. The waste developer is collected in the waste bottle. Over time, the waste bottle 4 becomes filled with developer and must be removed from the machine and replaced with an empty bottle.

Figure 2:
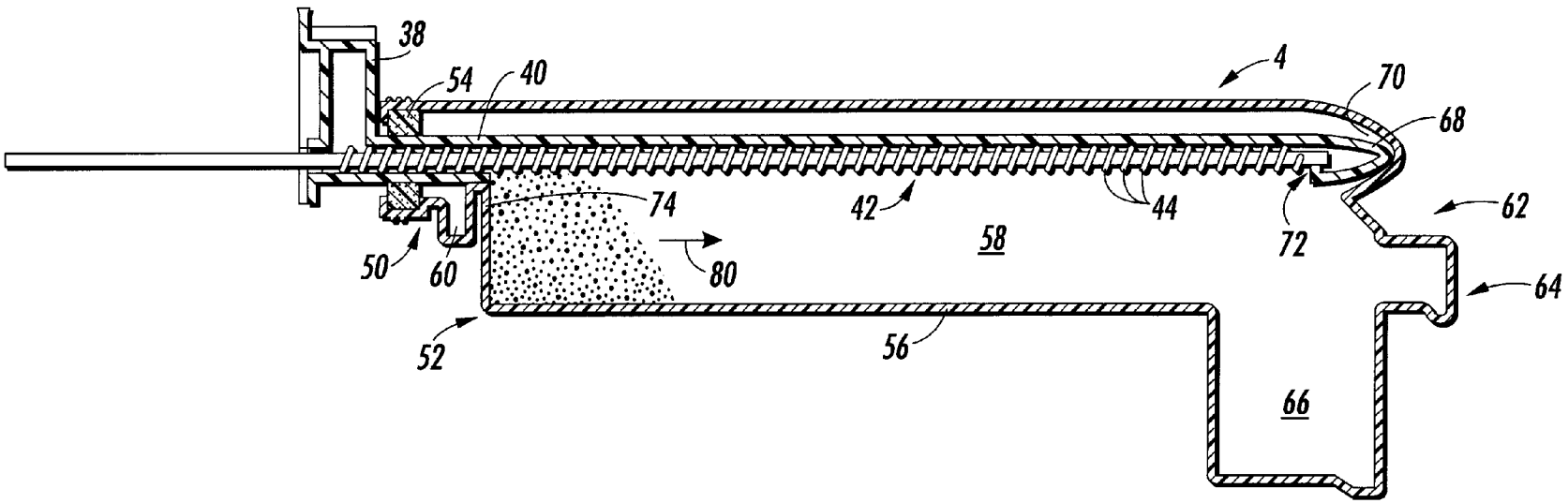
FIG. 2 is a cross-sectional side view of a developer waste bottle according to the present invention attached to a developer module.
Figure 3:
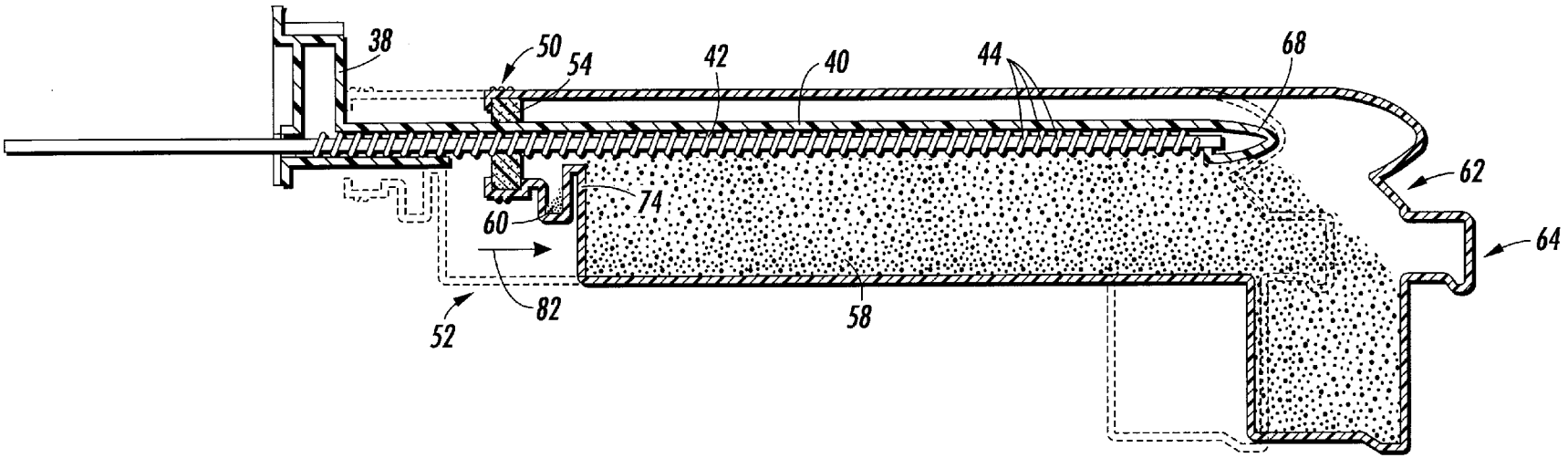
FIG. 3 is a cross-sectional view showing the waste bottle of FIG. 2 in the process of being removed from the developer housing.

Referring now to FIGS. 2 and 3, the illustrated waste bottle 4 is designed to fit in a long narrow space in an electrostatic reproducing machine. As such, the bottle is long, narrow and short, as opposed to tall, in shape, in order to take full advantage of the available space. A neck 50 is formed in the inboard end 52 of the bottle 4, near the top of the bottle. A doughnut shaped resilient seal 54 is sealingly affixed in the neck 50 of the bottle. The seal may be formed of open celled polyurethane foam, or other suitable material. The body or outer wall 56 of the bottle is shaped to define a waste collection chamber 58 and an overflow chamber 60 located between the collection chamber and the neck 50 of the bottle. The outboard end 62 of the bottle may be shaped to formed a handle 64 for grasping the bottle and removing it from the machine and an enlarged portion 66 in the collection chamber 58 for maximizing the storage capacity of the waste bottle 4.

The auger tube 40 and the auger 42 extend through the seal 54 in the neck 50 of the waste bottle 4, and through the interior of the bottle to the outboard end 62 of the bottle. The opening in the center of the seal 54 is formed with a diameter that is somewhat smaller than the outer diameter of the auger tube 40, such that an airtight seal is formed between the neck of the bottle and the auger tube. A tapered nose 68 on the end of the auger tube 40 is received in a mating recess 70 formed in the inner surface of the outboard end 62 of the bottle. The taper on the nose of the auger facilitates insertion of the auger through the hole in the seal 54. The portion of the auger tube 40 located in the collection chamber has a large longitudinally extending slot passing therethrough, such that approximately the lower half of the auger tube is open exposing the auger vanes 44 inside the collection chamber 58. The portion of the auger tube located in the overflow chamber 60 is not slotted. The unslotted portion of the auger tube meshes with or matingly abuts up against a partition 74 wall that separates the overflow chamber 60 from the collection chamber 58.

As previously described, the auger 42 is rotated by a motor (not shown) and thereby transports the waste developer through the auger tube 40 and into the waste bottle 4. The waste material travels through the unslotted portion of the auger tube, past the overflow chamber 60, and into the slotted portion of the auger tube located in the collection chamber 58. The waste developer falls through the open bottom 72 of the auger tube into the collection chamber where it is collected. The waste developer piles up at the inboard end 52 of the bottle, until the top of the pile contacts the vanes 44 of the auger 42, as illustrated in FIG. 2. As more waste developer is transported through the auger tube and into the bottle, the waste developer is transported along the top of the pile by the auger vanes and drops the down the outboard side of the pile. The waste bottle is thus slowly filled form its inboard end 52 to its outboard end 62, as indicated by arrow 80 in FIG. 2.

When the bottle 4 is filled with waste toner, as depicted in FIG. 3, the waste material building up against the outboard end 62 of the bottle trips a magnetic switch (not shown), or other suitable sensor, on the outside of the bottle. The switch sends a signal to the machine's controller (not shown), and the controller provides a message or signal to the customer or service technician informing them that the waste bottle is full. The customer or technician then replaces the bottle with an empty waste bottle. The full waste bottle is returned to the manufacturer for recycling of the bottle and developer material, or other suitable disposal of the waste developer and bottle.

In order to remove a full waste bottle 4 from the machine, the bottle is grasped by the handle 64 and pulled outward as indicated by arrow 82 in FIG. 3. As the bottle is moved out of the machine, the neck 50 of the bottles slides along the auger tube 40, until the neck of the bottle clears the nose 68 of the auger tube. Some of the waste developer collected in the collection chamber 58 is dragged toward the neck of the bottle by the auger vanes 44 (to the left in FIG. 3). The partition wall 74 traps the vast majority of the waste developer inside the collection chamber 58. Some of the waste developer being dragged by the auger vanes, however, is dragged over the partition wall 74 by the auger vanes. Since the overflow chamber 60 is void of developer, the waste developer that is dragged over the partition wall falls from the auger vanes 44 and is collected in the overflow chamber 60. As a result, the auger vanes are cleared of waste developer prior to passing through the seal 54 in the neck 50 of the bottle, and developer is substantially prevented from being dragged through the seal and falling off the auger into the machine.

An exemplary embodiment of the present invention has been described. After reading the description, those skilled in the art will identify various modifications that can be made to the embodiments described above without departing from the invention. For example, waste bottles having other shapes or overall proportions, other than the long narrow bottle illustrated and described, may incorporate an overflow chamber according to the present invention. Also, other mechanisms and or structures may be employed in the structure of the discharge unit 30 and the developer module 2. For example, an alternative feed mechanism, such as an auger or some sort of valve, may be employed in place of the described segmented roller 34 to control the discharge or trickle of replenisher from the discharge unit 30. Similarly, some sort of feed mechanism or valve may be employed to control the flow of waste developer being discharged from the developer housing 20 into the auger tube 40. Therefore, the above description is illustrative, and the scope of the claimed invention is not intended to be limited to the particular embodiments described above.

What is claimed is:

1. A container for collecting waste developer discharged from a developer module through a waste developer discharge conduit, comprising:

a housing defining a chamber including a partition wall dividing the chamber into a collection chamber and an overflow chamber, said housing having an opening formed in the region of the overflow chamber to receive said discharge conduit therethrough, said discharge conduit extending through said overflow chamber, over an inner edge of said partition wall and into said collection chamber, so that waste developer is discharged into said collection chamber.

2. The container of claim 1, wherein said inner edge of said partition wall abuts against an outer peripheral surface of said discharge conduit.

3. The container of claim 1, further comprising an auger in said discharge conduit, said auger including vanes extending along the length thereof.

4. The container of claim 1, further comprising a seal mounted in the opening of said housing, said seal engaging an outer peripheral surface of said discharge conduit to form a seal.

5. The container of claim 4, wherein said seal comprises a ring-shaped foam member.

6. An electrostatographic reproduction machine comprising:

a developer module having a discharge conduit extending therefrom for discharging waste developer from said developer module;

a waste collection bottle enclosing a chamber including a partition wall separating said chamber into a collection chamber and an overflow chamber, said bottle having an inlet opening in the region of said overflow chamber, said discharge conduit extending through said inlet opening, through said overflow chamber, over an inner edge of said partition wall and into said collection chamber, such that said waste developer is discharged into said collection chamber.

7. The machine of claim 6, wherein said inner edge of said partition wall nests with an outer peripheral surface of said discharge conduit.

8. The machine of claim 6, further comprising a seal mounted in said inlet opening, said seal engaging an outer peripheral surface of said discharge conduit to form a seal.

9. The machine of claim 8, wherein said seal is a generally annular foam member.

10. The machine of claim 6, further comprising an auger in said discharge conduit, said auger including vanes extending along the length thereof.

11. The machine of claim 10, further comprising a seal mounted in said inlet opening, said seal engaging an outer peripheral surface of said discharge conduit to form a seal.

* * * * *